United States Patent [19]

Yokokawa et al.

[11] 4,061,494

[45] Dec. 6, 1977

[54] FREE-CUTTING GRAPHITIC STEEL

[75] Inventors: Takao Yokokawa, Tokyo; Shogo Kanazawa, Kamakura; Yasuo Otoguro; Nobukazu Suzuki, both of Machida; Sigeyuki Akase; Noboru Miida, both of Sagamihara; Tadahisa Akazawa; Kazuya Kuroiwa, both of Muroran, all of Japan

[73] Assignee: Nippon Steel Corporation, Tokyo, Japan

[21] Appl. No.: 705,779

[22] Filed: July 16, 1976

Related U.S. Application Data

[63] Continuation-in-part of Ser. No. 687,583, May 19, 1976, abandoned, which is a continuation of Ser. No. 536,982, Dec. 27, 1974, abandoned.

[30] Foreign Application Priority Data

Dec. 28, 1973 Japan ..... 48-144720

[51] Int. Cl.[2] ..... C22C 38/02

[52] U.S. Cl. ..... 75/124; 75/123 E; 75/123 L; 75/123 M

[58] Field of Search ..... 148/12 F, 12 R, 35, 148/36; 75/123 R, 123 CB, 123 E, 123 L, 123 M, 124

[56] References Cited

U.S. PATENT DOCUMENTS

| | | | |
|---|---|---|---|
| 2,087,764 | 7/1937 | Bonte | 148/35 |
| 2,087,766 | 7/1937 | Forbes | 148/12 R |
| 2,362,046 | 11/1944 | Bonte | 75/123 L |
| 2,413,602 | 12/1946 | Bonte | 75/123 R |
| 2,883,281 | 4/1959 | Jatczak | 75/123 L |
| 2,974,035 | 3/1961 | Ototani | 75/123 E |
| 3,099,556 | 7/1963 | Jatczak | 148/36 |
| 3,290,185 | 12/1966 | Taub | 148/36 |

FOREIGN PATENT DOCUMENTS

| | | | |
|---|---|---|---|
| 46-26,213 | 7/1971 | Japan | 75/123 L |

*Primary Examiner*—Arthur J. Steiner
*Attorney, Agent, or Firm*—Toren, McGeady and Stanger

[57] ABSTRACT

A free cutting graphitic steel comprising:
Si: from more than 1.5 to 2.3%
Mn: 0.1 to 0.7%
S: not more than 0.015%
one or both Al and Ti: 0.015 to 0.1% in total
rare earth: 0.01 to 0.2% and
spheroidized graphite: 0.20 to 0.90% with the balance being iron and unavoidable impurities, said spheroidized graphite being distributed at a ratio of more than particles 50/mm$^2$.

1 Claim, 12 Drawing Figures

Relation Between Machinability and Number of Graphites

STEEL X X400

STEEL X X100

STEEL Y X 400

STEEL Y X100

STEEL Y X400

STEEL Y X 100

STRUCTURE AND CUTTING CHIP TREATABILITY OF STEELS X AND Y

FREE-CUTTING GRAPHITIC STEEL

CROSS REFERENCE TO RELATED APPLICATIONS

This application is a Continuation-in-Part of copending application Ser. No. 687,583, filed May 19, 1976, and now abandoned; which, in turn, is a continuation of application Ser. No. 536,982, filed on Dec. 27, 1974, and now abandoned.

BACKGROUND OF THE INVENTION

1. Field of the Invention

The present invention relates to a free cutting graphitic steel in which spheroidized graphite is contained in an amount between 0.20 and 0.90% and distributed at a ratio of more than 50 graphites (as defined herein) per square millimeters, so as to assure the desired machinability, and the C and Si contents are controlled so as to improve the hot workability.

2. Description of the Prior Art

The elements used in a free cutting steel to impart machinability to the steel, are primarily, S, P, Se, Pb, and Te. Among the various groups of free cutting steels, those steels in which sulfur is present and MnS is utilized as chip breaker are the most commonly used. However, the sulfur steels suffer the disadvantage that the properties are largely dependent upon the steel direction due to the development of banded structures and deterioration of the mechanical properties and hot shortness during hot working.

Meanwhile, Pb is used mostly in free cutting steels which are required to have good material quality since Pb remarkably improves the machinability without substantially effecting the mechanical properties.

At the present time, therefore, the free cutting steels which are commercially available may be classified largely into the sulfur steel group, the leaded steel group and the lead or sulfur complex steel group, and elements other than sulfur and lead are used only for an auxiliary role in the free cutting steels.

Lead is effective to increase the notch effect of a steel by adhering to the sulfides and oxides in the steel or by its distribution alone in the steel. It is effective to impart lubricity to the tool surface by its dissolution caused by the temperature rise during the machining operation.

Therefore, lead is more advantageous than sulfur from the standpoint of tool life improvement. However, since the air pollution problem has been of great concern in recent years, increased cost and labor are required for dust removal and handling during production and machining of leaded free cutting steels. Thus, strong demands have been made for free cutting steels which can be substituted for the lead-containing free cutting steels.

Steels utilizing graphite, e.g., a graphitic steel and a free cutting carbon tool steel are conventionally known. However, in these conventional steels, graphite is not utilized directly for improving the machinability of a structural steel.

For example, in the conventional graphitic steel, part of the carbides is decomposed into free graphite, but the combined carbon content is maintened at not less than 0.7%, so as to assure the desired heat treatment properties, and the steel has been used limitedly for parts, such as, drawing dies, taps, rolls and spindles which require good wear resistance.

Also, in the conventional free cutting carbon tool steel, graphitization is suppressed to 0.1 to 0.4% at the highest because excessive graphitization of the carbide lowers remarkably the heat treatment properties, and the machinability is maintained by the addition of Pb, S, Te, Se, etc.

In any event, both of the above conventional steels have been directed to wear resistant steel parts and tools, and are not directed to parts which are produced in mass by automatic machine tools. Yet, both of the conventional steels have poor hot workability properties and cannot be produced economically on a commercial scale by hot rolling with a rolling mill.

SUMMARY OF THE INVENTION

The present inventors have made extensive studies for producing a free cutting steel, and have discovered a carbon content, a silicon content and a graphite content and graphite distribution which can assure excellent hot workability and machinability. This, in turn, permits rolling without substantial manufacturing limitations on the hot rolling temperature and which can give simultaneously equal or better machinability than that of the conventional free cutting steels.

More particularly, the steel of the present invention has the following composition:

Si: from more than 1.5 to 2.3%
Mn: 0.1 to 0.7%
S: not more than 0.015% one or both Al and Ti: 0.015 to 0.1% in total
RE: 0.01 to 0.2% and
spheroidized graphite: 0.20 to 0.90% with the balance being iron and unavoidable impurities, said spheroidized graphite being distributed at a ratio or more than 50 graphites per $mm^2$.

DESCRIPTION OF THE PREFERRED EMBODIMENT

The composition of the steel according to the present invention is defined as shown in the following table.

TABLE 1

| Steel Composition of the Present Invention | |
|---|---|
| Si | more than 1.5 to 2.3% |
| Mn | 0.1 - 0.7% |
| S | less than 0.015% |
| Graphite | 0.20 - 0.90% |

TABLE 1-continued

| Steel Composition of the Present Invention | |
|---|---|
| One or both of Al, Ti | 0.015 - 0.1% in total |
| Total rare earth elements (RE) | 0.01 - 0.20% |
| Balance | Fe and impurities |

Figure 2:
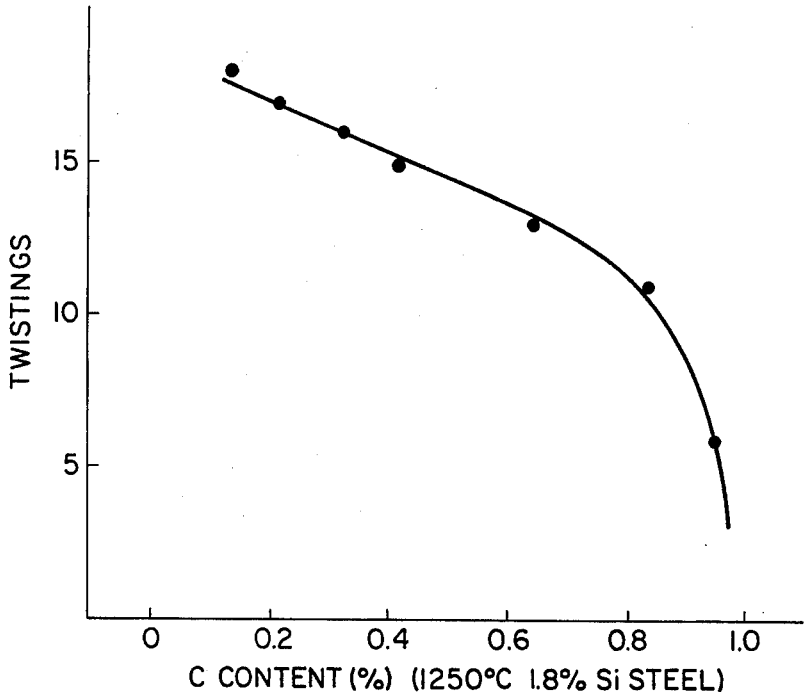
FIG. 2 shows the relation between the times of twisting in a hot torsion test (1250° C) and the carbon content in 1.8% Si steel.

The reasons for the limitations on the steel composition in the present invention are as follows:

Carbon is an indispensable element for forming the graphite which is necessary to assure the desired machinability of the steel and which is the most important property to be obtained with the present invention. However, the lower limit of the carbon content is defined as 0.20% on the basis of the lower limit of graphite which is effective to obtain the machinability. Its upper limit is defined as 0.9%, because if the carbon content exceeds 0.90%, the hot workability required for the commercial mass production of the steel cannot be obtained and the production yield and efficiency lower due to surface defects, even when rare earth elements (RE) are added as shown in FIG. 2. The graphitization is effected within the carbon range defined above.

Figure 4:
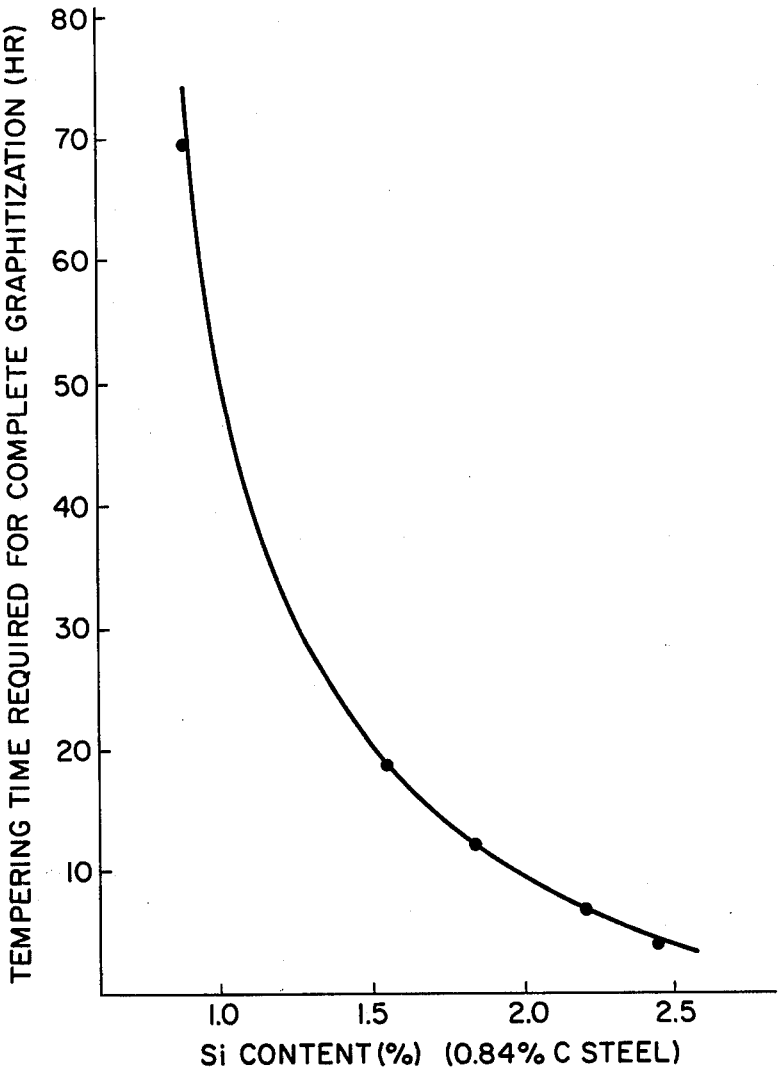
FIG. 4 shows the relation between the tempering time required for 100% graphitization by quenching and tempering and the silicon content in 0.84% C steel.
Figure 5:
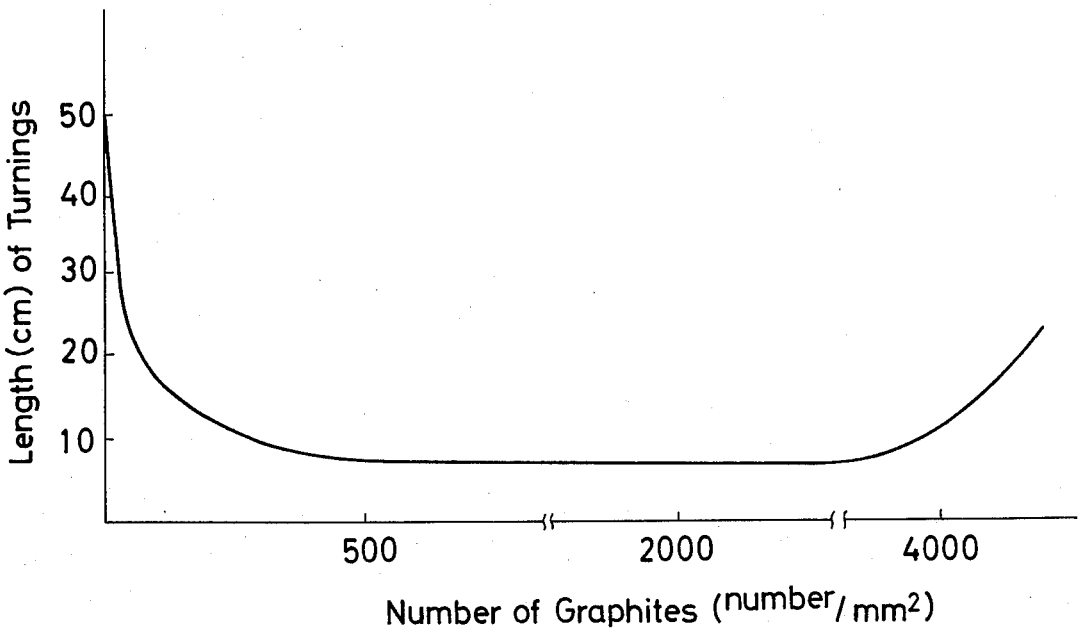
FIG. 5 shows the relation between the machinability and the number of graphites.

Regarding silicon, it has been conventionally well known in steel castings that silicon promotes remarkably graphitization, and silicon is an indispensable element also in the present invention for simplifying the graphitization heat treatments. With a silicon content of 1.5% or less, however, the annealing time is very long, i.e., about 20 hours and is thus impractical. This is clear from FIG. 4 and occurs even when rare earth elements (RE) are added and the graphitization is performed by quenching and tempering. For this reason, the lower limit of silicon is defined as greater than 1.5%.

Figure 3:
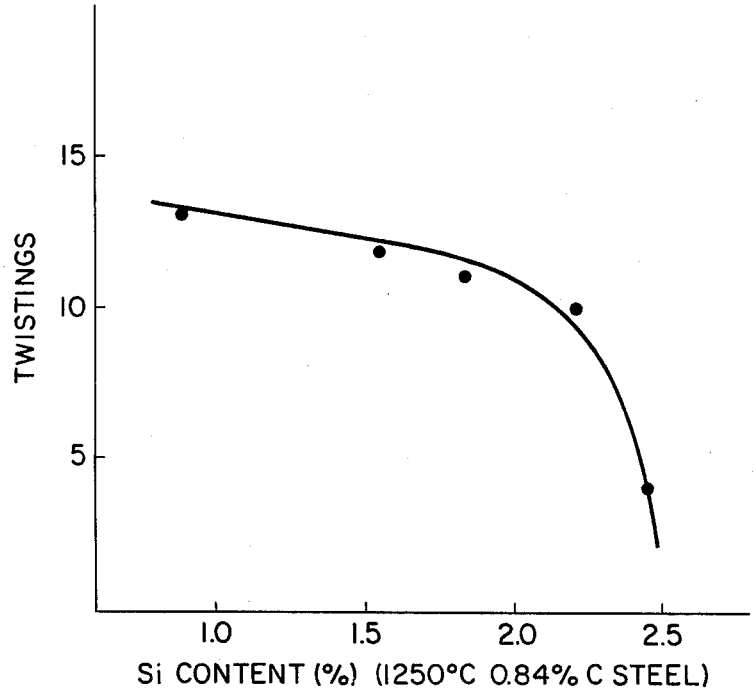
FIG. 3 shows the relation between the times of twisting in a hot torsion test (1250° C) and the silicon content in 0.84% C steel.

On the other hand, the upper limit of silicon is defined to 2.3% in view of the lowering of the hot workability due to the lowered eutectic point as shown in FIG. 3 and to obtain the desired cleanness of the steel.

Sulfur hinders graphitization and has a harmful effect on the toughness of the steel. It is thus desirable that the sulfur content is mainted as low as possible. In the case of a graphitic steel, a sulfur content of more than 0.015% has a remarkable tendency to deteriorate the toughness, and thus the upper limit of sulfur is defined as 0.015%, and preferably is 0.01%. The amount of graphite is the main feature of the present invention and is the most important factor which controls the machinability.

Figure 1:
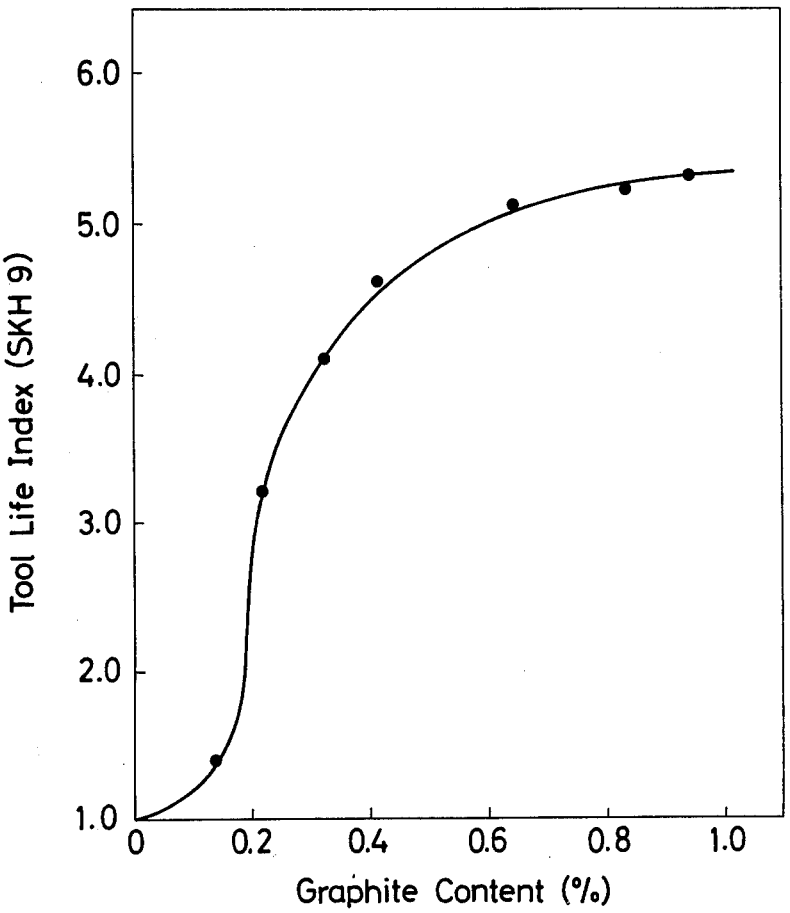
FIG. 1 shows the relation between the graphite content and the tool life index (ratio to the life of a tool in machining a steel containing no graphite which is taken as 1).

As clearly understood from FIG. 1, unless the graphite exists in an amount of more than 0.20%, substantial improvement of the tool life cannot be expected, and thus, the lower limit of the graphite content is defined to 0.20%. This is also in view of the chip disposal.

Regarding the upper limit of the graphite content, it is limited to 0.90% because otherwise, the carbon content is restricted from the point of hot workability.

As for the graphite distribution, when the graphite is extremely large and the number of graphites per unit area is small, the chips take a continuous form, and thus at least 50 graphites per square millimeter and preferably 500 to 4000 graphites per square millimeter are required. As used herein, 50 graphites per square millimeter correspond to more than 50% graphite having a particle size not larger than 30 $\mu$.

Manganese is used as a deoxidizer for the steel and also as a strengthening agent for increasing the strength of the steel. For satisfactory deoxidation of the steel and for obtaining a sound steel ingot, at least 0.1% manganese is necessary. On the other hand, manganese hinders graphitization and a large amount of manganese is not desirable.

Particularly, when the manganese content exceeds 0.7%, a longer period of time is required for graphitization. Thus, the upper limit of manganese is defined to 0.7%, while the lower content is defined to 0.1% in view of its deoxidization effect.

Aluminum and titanium, like silicon, are also effective for promoting graphitization. However, no substantial effect can be obtained when these elements are less than 0.015%, respectively. On the other hand, when they are present in an amount of more than 0.1%, the steel surface condition is worsened and also internal defects, such as, lamination are caused. Thus, their upper limits are limited to 0.1% and their lower limits are defined as 0.015%.

The rare earth metals (hereinafter called RE) used in the present invention mean elements from the atomic numbers 57 (La) to 71 (Lu), and are added in a range from 0.01 to 0.2% alone or in combination for the purpose of promoting the spheroidization of the graphite and improving the hot workability of the steel. When the content of RE is less than 0.01%, an improvement of the hot workability is not detectable, while further improvement is not obtained when RE is present in an amount exceeding 0.2%. Rather, (in this case) the workability lowers. Thus, the upper limit and the lower limit of RE are defined to 0.2% and 0.01%, respectively. Further, when RE is present in an amount less than the lower limit, the tempering time required for graphitization increases considerably and the heat treatment efficiency lowers. For example, in the case of a steel having a similar composition as the steel L in the example, if RE is not present, the tempering time requires 40 hours, which is about two times longer than of the steel L.

The steel according to the present invention can be easily produced by the ordinary steel-making process, such as, in a convertor and electric furnace, and no special or unusual conditions are required for the rolling operation.

The heat treatment for graphitization is done by slow cooling between about 800° and 600° C after the rolling, tempering between about 600° and 800° C, quenching from between about 750° and 1000° C, or annealing between about 600° and 800° C. However, in the case of certain steel grades, a seed charge is added prior to ingot casting to effect inoculation for promoting graphitization.

Table 2 shows the composition of the sample steels, graphite contents, material quality, tempering time required, graphitization, times of twisting in torsion tests at 1250° C, surface conditions as rolled, and tool life indexes in the case where a high speed steel tool was used (drilling conditions; feed speed: 0.33 mm/rev., bore depth of drilled hole: 30 mm, drill SKH9 of 10 mm diameter, wet cutting; the cutting speed with which the total cutting length until the end of the tool life is 2000 mm is expressed as VL = 2000, and the life index is expressed as a multiple of the VL of the comparative steel A).

The steels E, F, G, H, I, L, M and Q in Table 2 belong to the basic composition of the present invention, and the steels A, B, C, D, J, K, N, O, P and R are comparative steels, respectively.

Steel A has a similar level of strength as the steel of the present invention, but does not contain graphite.

Steel D contains 0.14% graphite which is outside the scope of the present invention. Both steels A and D show a short tool life as compared with the steel of the present invention.

Steel B is a leaded free cutting steel, steel C is a sulfur-containing free cutting steel, and both steels B and C are inferior to the steel of the present invention with respect to pollution prevention and hot workability, respectively.

Steel J has a carbon content outside the scope of the present invention, and does not exhibit good hot workability.

Steels K and N are comparative steels having a silicon content outside the scope of the present invention, and steel K requires more than 48 hours tempering time for complete graphitization even by a quenching-tempering graphitization treatment and thus this steel is of no practical use. Steel N has an excessively high silicon content so that the eutectic point is lowered by the complex effect with carbon and thus the hot workability is remarkably deteriorated.

Steels E, F, G, H, I, L and Q, which are within the scope of the present invention, can be easily rolled with a soaking temperature of 1250° C which is commonly used in ordinary commercial production, and thus these steels do not present production problems and are equal to the leaded or sulfur-containing steel with respect to turnings handling, and equal or better than the leaded or sulfur-containing steel with respect to the tool life.

Thus, it is clear that the steel of the present invention is superior to the conventional sulfur-containing free cutting steel with respect to hot workability, tool life, and does not contain harmful elements, such as, Pb, Bi, Te, while the machinability is equal or better than that of the conventional steels.

TABLE 2

Chemical Compositions of Sample Steels and Their Properties

| | C | Si | Mn | P | S | Al | Ti | Pb | Total RE | Graphite |
|---|---|---|---|---|---|---|---|---|---|---|
| A* | 0.15 | 0.30 | 0.62 | 0.015 | 0.017 | | | | | 0 |
| B* | 0.15 | 0.30 | 0.64 | 0.016 | 0.014 | | | 0.18 | | 0 |
| C* | 0.12 | 0.01 | 0.82 | 0.013 | 0.26 | | | | | 0 |
| D* | 0.14 | 1.80 | 0.35 | 0.011 | 0.006 | 0.018 | 0.021 | | 0.14 | 0.14 |
| E | 0.22 | 1.86 | 0.28 | 0.011 | 0.008 | 0.036 | 0.002 | | 0.13 | 0.22 |
| F | 0.33 | 1.85 | 0.36 | 0.012 | 0.005 | 0.024 | 0.015 | | 0.10 | 0.33 |
| G | 0.42 | 1.82 | 0.34 | 0.013 | 0.006 | 0.022 | 0.018 | | 0.18 | 0.42 |
| H | 0.65 | 1.83 | 0.36 | 0.013 | 0.005 | 0.012 | 0.028 | | 0.09 | 0.65 |
| I | 0.84 | 1.84 | 0.33 | 0.015 | 0.005 | 0.019 | 0.024 | | 0.12 | 0.84 |
| J* | 0.05 | 1.84 | 0.36 | 0.012 | 0.007 | 0.025 | 0.016 | | 0.14 | 0.95 |
| K* | 0.84 | 0.90 | 0.35 | 0.016 | 0.006 | 0.021 | 0.018 | | 0.13 | 0.84 |
| L | 0.84 | 1.55 | 0.28 | 0.014 | 0.006 | 0.035 | 0.004 | | 0.14 | 0.84 |
| M | 0.84 | 2.21 | 0.31 | 0.016 | 0.007 | 0.010 | 0.036 | | 0.19 | 0.84 |
| N* | 0.84 | 2.46 | 0.34 | 0.015 | 0.006 | 0.018 | 0.022 | | 0.15 | 0.84 |
| O* | 0.84 | 2.23 | 0.35 | 0.016 | 0.007 | 0.021 | 0.022 | | 0.25 | 0.84 |
| P* | 0.83 | 2.25 | 0.37 | 0.012 | 0.006 | 0.017 | 0.024 | | 0.008 | 0.83 |
| Q | 0.85 | 2.26 | 0.35 | 0.013 | 0.006 | 0.030 | 0.012 | | 0.015 | 0.85 |
| R* | 0.84 | 2.26 | 0.35 | 0.015 | 0.006 | 0.020 | 0.019 | | — | 0.84 |

| | Tensile Properties | | Tool Life | Tempering Time for | Rolling | | High Temperature Torsion Test |
|---|---|---|---|---|---|---|---|
| | Tensile Strength | Elongation | Index SKH 9 | Graphitization (hr) | Heating Temp. | Surface Condition | Twisting Times (1250° C) |
| A* | 48.3 | 32.1 | 1.0 | | 1280° C | good | 21 |
| B* | 47.8 | 31.8 | 4.3 | | 1280° C | good | 18 |
| C* | 44.5 | 32.4 | 4.5 | | 1250° C | crack | 3 |
| D* | 43.2 | 34.4 | 1.4 | 25 | " | good | 18 |
| E | 47.8 | 33.2 | 3.2 | 20 | " | good | 17 |
| F | 47.7 | 32.5 | 4.1 | 16 | " | good | 15 |
| G | 47.2 | 33.1 | 4.6 | 15 | " | good | 15 |
| H | 48.5 | 34.8 | 5.1 | 13 | " | good | 14 |
| I | 48.4 | 35.1 | 5.2 | 12 | " | good | 11 |
| J* | 48.3 | 34.9 | 5.3 | 10 | " | surface defect | 6 |
| K* | 42.1 | 40.2 | 5.0 | 70 | " | good | 13 |
| L | 45.7 | 39.2 | 5.0 | 19 | " | good | 12 |
| M | 50.8 | 32.3 | 5.2 | 7 | " | good | 10 |
| N* | 52.6 | 31.6 | 5.3 | 4 | " | surface defect | 4 |
| O* | 50.6 | 32.5 | 5.2 | 7 | " | bad | 8 |
| P* | 51.1 | 32.0 | 5.2 | 15 | " | surface defect | 6 |
| Q | 50.6 | 32.2 | 5.2 | 11 | " | good | 9 |
| R* | 50.0 | 32.8 | 5.2 | 15 | " | surface defect | 6 |

Remark:
*means comparative steels

The following experiment illustrates the importance of the silicon content in the steel of the present invention with respect to the machinability.

Steels X and Y with the compositions as shown in Table 3 were hardened at 920° C and tempered at 680° C. Steel X contains 2.0% Si and is an example of the present inventive steel, and steel Y is outside of the scope of the present invention. Their microscopic structures are shown in FIG. 6 (× 100 and 33 400), and their machinabilities, measured by the cut chip index, are shown in Table 4.

TABLE 3

| | Chemical Composition (%) | | | | | | |
|---|---|---|---|---|---|---|---|
| | C | Si | Mn | P | S | Ti | Al |
| Steel X | 0.45 | 1.6 | 0.36 | 0.014 | 0.008 | 0.029 | 0.024 |
| Steel Y | 0.45 | 1.3 | 0.37 | 0.016 | 0.008 | 0.020 | 0.023 |

TABLE 4

| | Cut Chip Index | | |
|---|---|---|---|
| | 680° C, 5 hrs. | 680° C, 20 hrs. | 680° C, 50 hrs. |
| Steel X | 5 | 4 | — |
| Steel Y | 9 | 7 | 5 |

Cutting condition:
Cutting tool — SKH 4
Depth of Cut — 1.0 mm

Feed — 0.16 mm/rev.

Cutting speed — 50 m/min.

Figure 7:
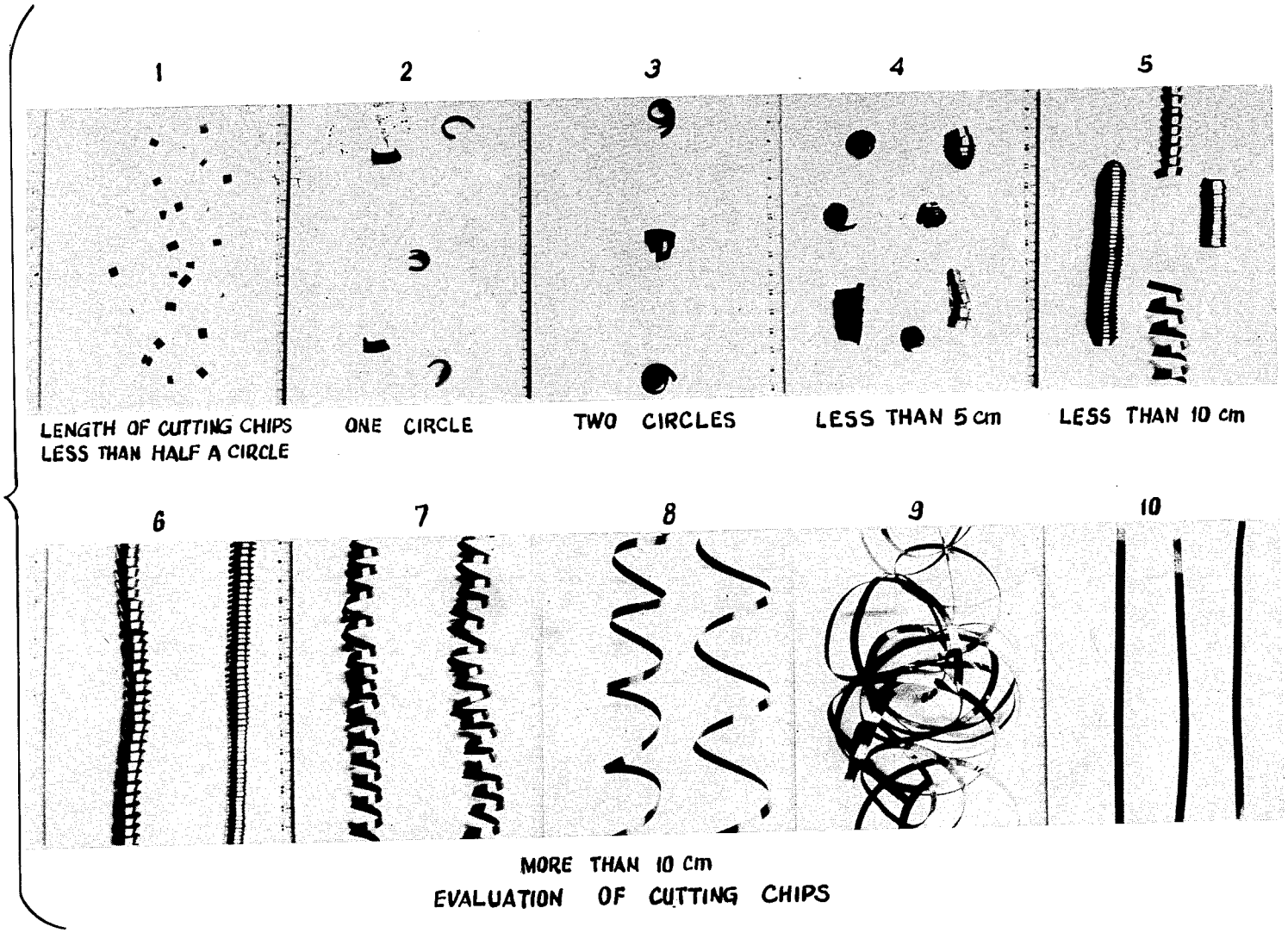
FIG. 7 is a series of photographs of standards for measuring the cut chip index.

Evaluation of cut chips (cut chip index) — according to the standards in FIG. 7.

Figure 6D:
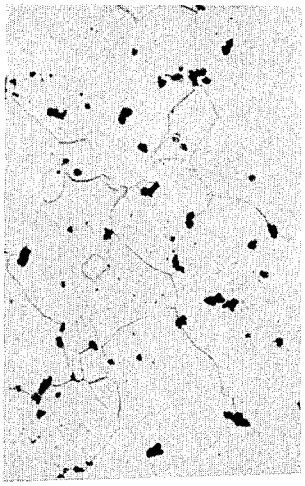
FIGS. 6*a*, 6*b*, 6*c*, 6*d*, 6*e*, and 6*f* are comparative photomicrographs of steel samples showing the graphitic particle distribution.
Figure 6A:
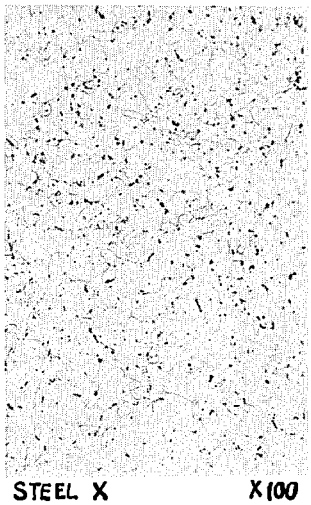
Figure 6E:
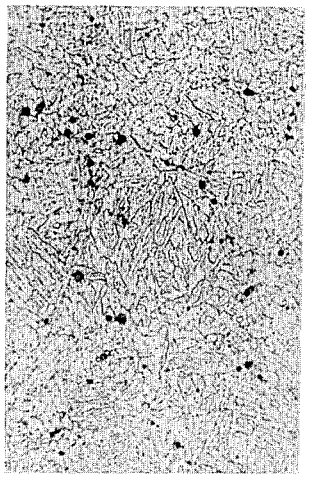
Figure 6B:
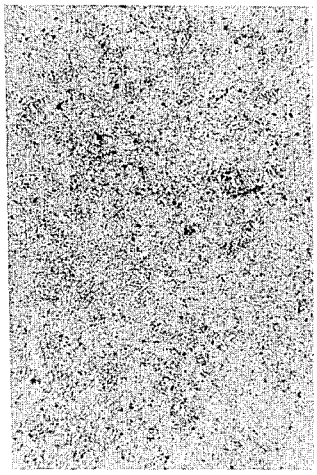
Figure 6F:
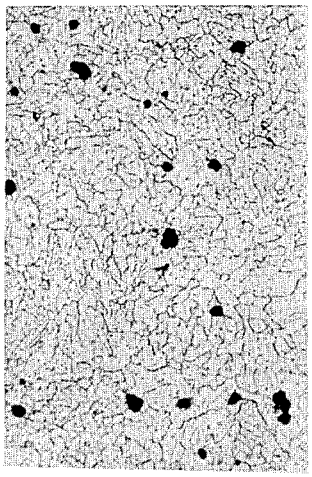
Figure 6C:
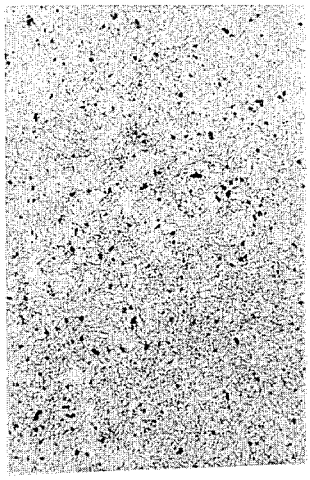

As obvious from FIGS. 6*a,b,c,d,e,* and *f,* whereas Steel X showed complete graphitization by the tempering at 680° C for only 5 hours, Steel Y did not exhibit satisfactory graphitization after 5 hours and even after 50 hours tempering at the same temperature (the structure comprised ferrite, nodular cementite and graphite). As a consequence, as obvious from Table 4 and FIG. 7, whereas the cut chips of X were not long and broken in pieces, the machinability of Y was very inferior. It is apparent that, in the present inventive steel, the disposal of cut chips is quite easy and the cutting efficiency can be improved remarkably. As shown by FIG. 7, the cut chip index is classified into ten classes according to numbers or length of the chip and a greater class number represents stronger tendency of continuation of chips, thus more difficult disposal of cut chips. Normally, a class number not larger than 5 assures no problem in disposal of chips in lathing.

The cut chip index as shown in FIG. 7 is a follows:

| Length of cut chip | Index |
|---|---|
| Less than half circle | 1 |
| one circle | 2 |
| two circles | 3 |
| less than 5 cm | 4 |
| less than 10 cm | 5 |
| more than 10 cm | 6 – 10 (depending on twisting.) |

What is claimed is:

1. A free cutting graphitic steel consisting essentially of

Si: from more than 1.5 to 2.3%

Mn: 0.1 to 0.7%

S: not more than 0.015% one or both Al and Ti in a total amount of: 0.015 to 0.1% rare earth: 0.01 to 0.2% and spheroidized graphite: 0.20 to 0.90% with the balance being iron and unavoidable impurities, said spheroidized graphite being distributed at a ratio of more than 50 graphites per $mm^2$.

* * * * *